United States Patent [19]

Sontag et al.

[11] 3,964,669

[45] June 22, 1976

[54] COMPOSITE WRAPPER COMBINING RIGID AND FLEXIBLE ELEMENTS

[75] Inventors: Glenn R. Sontag, Oconomowoc; Benjamin M. Tranholm, Milwaukee, both of Wis.

[73] Assignee: Milprint, Inc., Milwaukee, Wis.

[22] Filed: Sept. 2, 1975

[21] Appl. No.: 609,253

[52] U.S. Cl. ..... 229/40; 229/14 R; 229/87 F

[51] Int. Cl.[2] ..... B65D 5/08

[58] Field of Search ..... 229/14 R, 14 BW, 40, 229/87 F; 206/45.14, 392

[56] References Cited

UNITED STATES PATENTS

| | | | |
|---|---|---|---|
| 1,386,374 | 8/1921 | Smith | 229/40 |
| 1,437,512 | 12/1922 | Gereke | 229/40 |
| 2,870,023 | 1/1959 | Vogt | 229/87 F |
| 3,180,554 | 4/1965 | Becker | 229/42 |
| 3,392,900 | 7/1968 | Vogt | 229/40 |
| 3,458,112 | 7/1969 | Nelson | 229/40 |
| 3,621,990 | 11/1971 | Hartman | 229/14 R |
| 3,834,610 | 9/1974 | Eifrid | 229/40 |

*Primary Examiner*—William Price
*Assistant Examiner*—Bruce H. Bernstein
*Attorney, Agent, or Firm*—Quarles & Brady

[57] ABSTRACT

A composite wrapper combining a rigid foldable member joined to a flexible packaging film member, wherein the rigid member is the inner element and provides a sleeve or box-like support when the package is completed and the flexible member is the outer element and extends beyond either side of the rigid member so as to be folded to complete the package enclosure. The rigid member includes a base panel having liftable flaps which can be raised to an upright position and wall panels which can be folded about an article packaged in the wrapper.

6 Claims, 12 Drawing Figures

COMPOSITE WRAPPER COMBINING RIGID AND FLEXIBLE ELEMENTS

BACKGROUND OF THE INVENTION

This invention relates to packages which combine a rigid packaging member and a flexible packaging film in a composite construction, particularly in the form of a blank which can be erected into an enclosed package after an article is placed on the construction.

Packaging materials are often supplied to the ultimate packager in the form of cartons, blanks which can be erected into cartons, bags or pouches made of flexible material, or sheets or rolls of flexible packaging film. The packager inserts the articles in the selected type of package for delivery or shipment to a customer. In a store, for example, a sales person may pack the customer's chosen article in an appropriate container selected at least to some extent, on the basis of the degree of protection needed for the packaged article. Broadly speaking, a rigid package such as a carton of paperboard or plastic will give more protection to its contents than a package made from flexible packaging film such as plastic, paper or composite film structures. Generally, however, it will take longer for the packager to pack the article in a rigid container such as a carton, particularly when the carton is supplied in the form of a flat blank which is to be erected at its point of end use, than is the case with the use of flexible packaging containers such as bags or pouches.

One of the fields which uses various types of packaging materials are the restaurants generally referred to as fast-food operations, particularly those which sell sandwiches such as fish sandwiches, hamburgers, etc. The typical containers now employed for packaging food products in such businesses include various types of rigid containers such as paperboard boxes or open-topped holders in which a sandwich or other food is inserted, or flexible wrappers such as sheets of wax paper or other similar materials which are wrapped around a sandwich. While numerous types of containers are in general use, none of them completely satisfies the need that has developed for a package that can meet the diverse requirements of an attractive package which can be of aid to facilitate the preparation of sandwiches and other foods, protect foods until delivery to the consumer, and which can also be used by the consumer when he eats the food product. Our invention is intended to provide a novel package which can be useful in these and other types of packaging applications.

SUMMARY OF THE PRESENT INVENTION

Our present invention provides a composite wrapper made of a relatively rigid foldable member joined to a flexible film member. The rigid member includes a series of panels so as to be foldable into a band-like or sleeve element about an article to be packaged, and more particularly includes a base panel containing liftable flaps that can be raised upright and positioned about an article to be packaged in the composite wrapper. The flexible member of the construction extends beyond the rigid member on two sides thereof and includes panels which can be folded to complete the package enclosure.

DESCRIPTION OF THE DRAWINGS

Presently-preferred embodiments of this invention are shown in the accompanying drawings, wherein.

Figure 1:
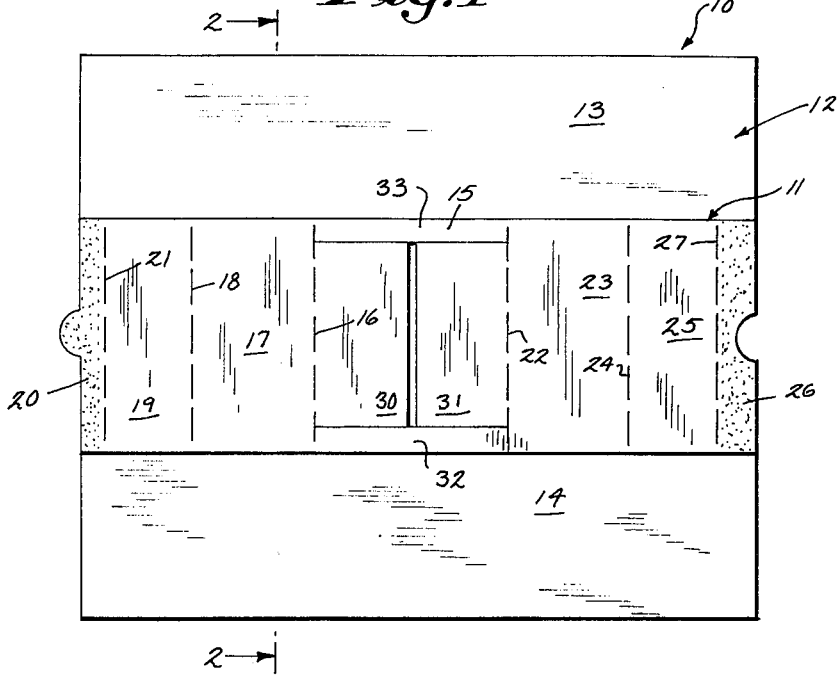
FIG. 1 is a plan view of a composite wrapper according to our invention.
Figure 2:
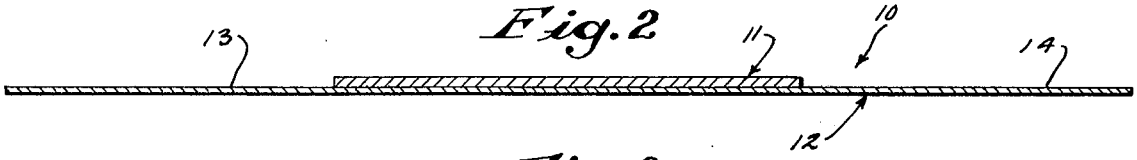
FIG. 2 is a sectional view taken along the plane of line 2—2 of FIG. 1.
Figure 3:
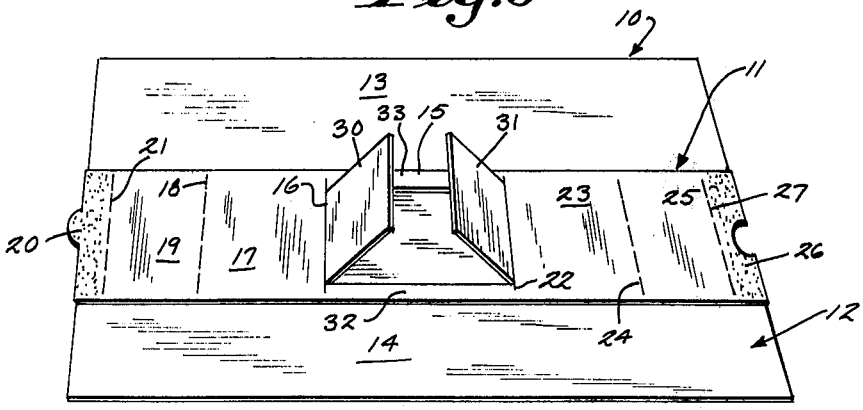
FIG. 3 is a perspective view of an initial step in the process of forming a container from the composite wrapper of FIG. 1.

DESCRIPTION OF THE PREFERRED EMBODIMENTS a. FIGS. 1 and 2

FIGS. 1 and 2 illustrate a composite wrapper 10 according to the present invention which includes a rigid member 11 joined to a flexible member 12. The flexible member 12 is wider than the rigid member 11, and includes marginal portions 13 and 14 which extend beyond the rigid member 11 on opposite sides thereof. In the form illustrated in FIG. 1, the center line of the rigid member 11 is superimposed on the center line of the flexible member 12, although in an appropriate instance the rigid member can be offset relative to the center line of the flexible element. The rigid member 11 will form the inner element of a finished package made from the wrapper, and the flexible member will be the outer element.

The rigid member 11 includes a base panel 15 connected at one end along fold line 16 to a first wall panel 17 which in turn is connected at its opposite end along fold line 18 to a third wall panel 19, and a closure tab 20 is connected to the opposite end of the third wall 19 along fold line 21. On its other end, the base panel 15 is connected along fold line 22 to second wall panel 23 which is connected along fold line 24 to fourth wall panel 25, and closure tab 26 is connected to the opposite side of the fourth wall panel along fold line 27.

The base panel 15 is cut or scored to define a pair of liftable flaps 30 and 31 which are hinged along fold lines 16 and 22, respectively, for the purposes hereinafter described. The remaining side portions 32 and 33 of the base panel extend between the fold lines 16 and 22. As to the relative sizes of the respective wall panels, the base panel 15 is of an appropriate size so as to be large enough to hold the article which is to be packaged. The first and second wall panels 17 and 23, respectively, will form vertical sides of the finished package and should be wide enough (measured parallel to the center line of the rigid member) to provide the height desired in the complete package. The third and fourth wall panels 19 and 25, respectively, as will be shown below are meant to be folded across the top of the container portion of the erected carton and these panels will each have a width of about one-half of that of the base panel.

The rigid member 11 of the wrapper 10 may be a blank formed of any suitable foldable material, such as paperboard, cardboard, plastic film, foil/paper film, or plastic/paper film, or other foldable materials. It may be an uncoated material or it can include functional coatings, such as a heat seal coating and/or barrier coating, as are of general use in the carton art. The fold lines can be formed in the rigid member by any suitable creasing or scoring mechanism which will define a line along which the rigid member may be folded in order to form the finished package. The base panel 15 may be cut to define the liftable flaps 30 and 31 by suitable known die-cutting mechanisms and these may be formed as a continuous slit that extends entirely through the thickness of the base panel as indicated in the drawings, or they may be formed by means of perforated lines, such as spaced slits or spaced perforations, that can be separated from the balance of the wall panel when it is desired to raise the flaps to package an article. The rigid member 11 can be any thickness suitable for the finished product which is to be packaged although paperboard or similar materials of about 8 to 15 mils thick will generally be suitable.

The flexible member 12 of the composite wrapper 10 may be any of the various types of flexible packaging films generally used in the packaging art. Thus the flexible member may be made of plastic film such as polyethylene, polypropylene, cellophane, vinyl, nylon, etc., and can include one or more similar or dissimilar layers; it may be made of plastic films such as the foregoing laminated to a paper layer or metal foil layer and it may be made of any of the foregoing films which include functional coatings, such as a heat seal coating or barrier coating, depending upon the end use of the material and the manufacturing techniques to be employed in its construction. The thickness of the flexible member can be chosen as may be appropriate for the use of the carton, although generally films of about 2 to 10 mils thick will be suitable for most applications. The flexible member can be printed with decorative or informative material as desired.

The rigid member 11 is to be joined to the flexible member 12 to form the composite wrapper 10. This joinder may be effected by adhesive lamination, heat seal joinder, or mechanical fasteners if appropriate. The rigid member 11 can be coated on its undersurface which is to be joined to the flexible member with a suitable adhesive, such as wax adhesive layers, urethane, adhesives, etc., or it can be heat sealed to the flexible member if either of the two members are made of a material that was inherently heat sealable or if either or both of them have a heat seal coating on its appropriate surface. In most instances, the entire rigid member will be joined to the flexible member 12 except that the liftable flaps 30 and 31 are not connected to the flexible member in order that they may be raised from the flexible member as described hereinafter. Thus, the panels and tabs 17, 19, 20, 23, 25 26 and side portions 32 and 33 will normally be joined to the flexible member 12.

b. FIGS. 3–8

Figure 4:
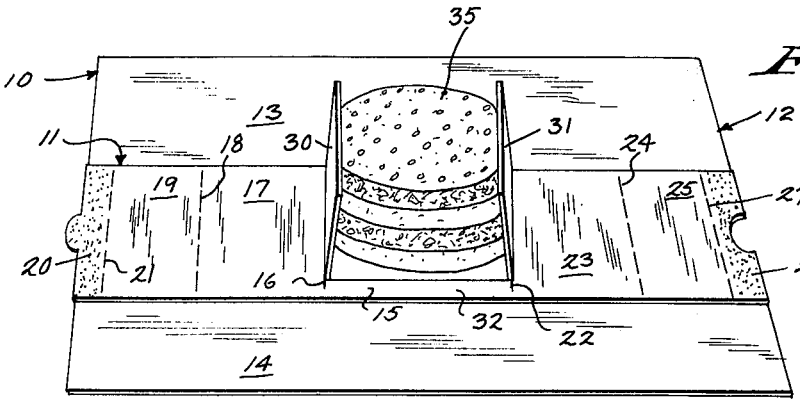
FIG. 4 is a succeeding step showing the placement of an article to be packaged in a wrapper of the present invention.

The use of the composite wrapper 10 for packaging articles is illustrated in the sequential views of FIGS. 3–8. Beginning with FIG. 3, the initial step in the operation is to raise the liftable flaps 30 and 31 of the base panel 15 to an approximately vertical position. Turning next to FIG. 4, the operator places the article to be packaged between the two upright flaps 30 and 31 so that it rests upon the portion of the flexible member 12 exposed by the lifting of such flaps. In this drawing, a hamburger is shown as being packaged in the wrapper 10 although various types of food and non-food articles can be placed therein. One of the advantages of the wrapper 10 of this invention is that the hamburger 35 or other article can be assembled on the wrapper itself after the flaps 30 and 31 are folded to their upright position. Thus the operator can first place the lower half of the bun on the wrapper, add the meat and the assorted ingredients, and complete the sandwich by applying the upper half of the bun. The present wrapper provides the feature of facilitating assembly of the article to be packaged and eliminates the need to first make it and then transfer it to the package in which it is to be wrapped.

Figure 5:
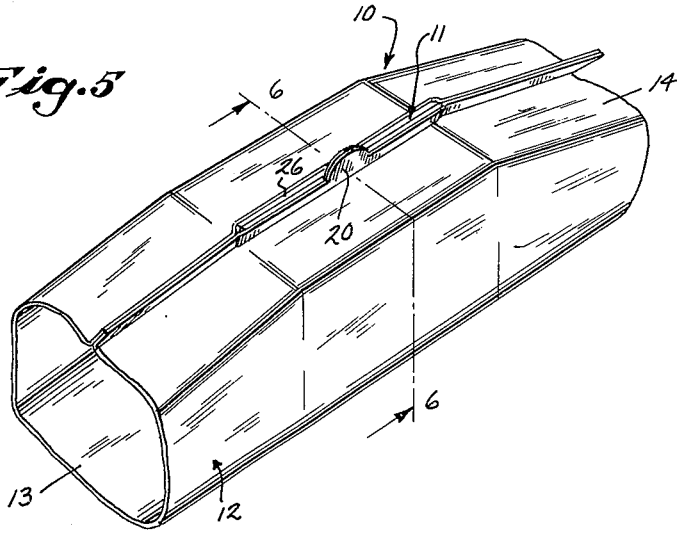
FIG. 5 illustrates completion of the step of folding the rigid member of the present composite wrapper about the article being packaged.
Figure 6:
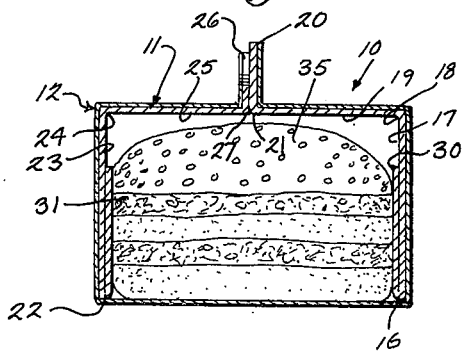
FIG. 6 is a cross sectional view of the package taken along the plane of 6—6 of FIG. 5.

Turning next to FIGS. 5 and 6, after the article has been placed on the base panel as shown in FIG. 4, the rigid member is folded about the fold lines 16, 18, 21 and 22, 24 and 27 so that the first wall panel 17 and second wall panel 23 are positioned alongside the upright flaps 30 and 31 to form the side walls of the package and the third wall panel 19 and fourth wall panel 24 are folded so as to extend over the top of the article. At this stage, the rigid member has been folded to an open-ended sleeve about the article being packaged. The closure tabs 20 and 26 may be coated with a pressure sensitive adhesive on their inner surfaces as indicated by the stippling in FIG. 1 so that after the package is in the condition of FIG. 5, the two closure tabs can be pressed together in order to seal the package. Other closure systems can be employed, however, such as locking tab constructions in which one of the closure tabs has a tab element that can be inserted in a slit on the other element, or the closure tabs can be appropriately structured so as to be folded one upon the other in order to close this portion of the package, or the closure tabs can be heat sealed together if they have a heat sealable coating or are made of a heat sealable material. Also, if desired, mechanical fasteners, such as staples, etc., can be used to join the two closure tabs together.

Figure 7:
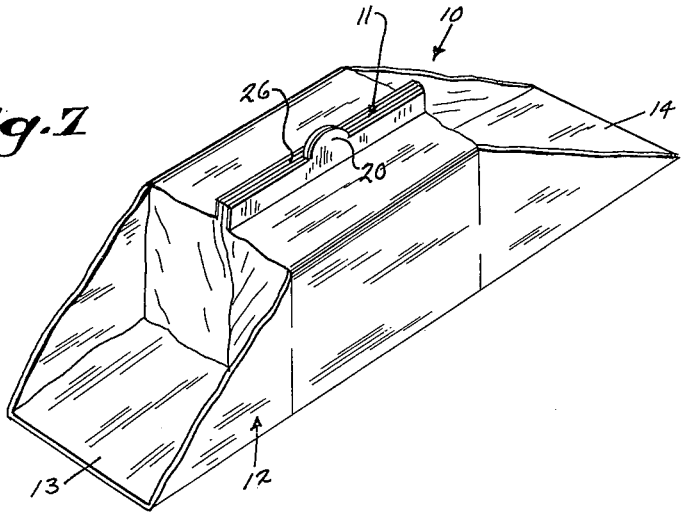
FIG. 7 is a perspective view showing an initial stage of the folding of the flexible film member of our present composite package to enclose the ends of the package.
Figure 8:
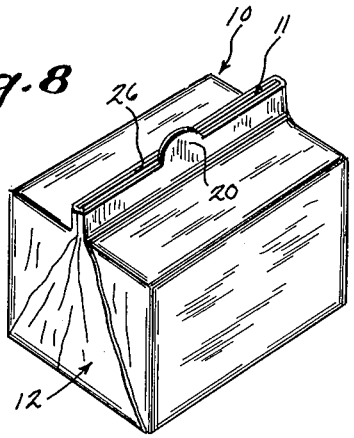
FIG. 8 is a perspective view of the finished package assembled according to the steps illustrated in FIGS. 3–7.
Figure 9:
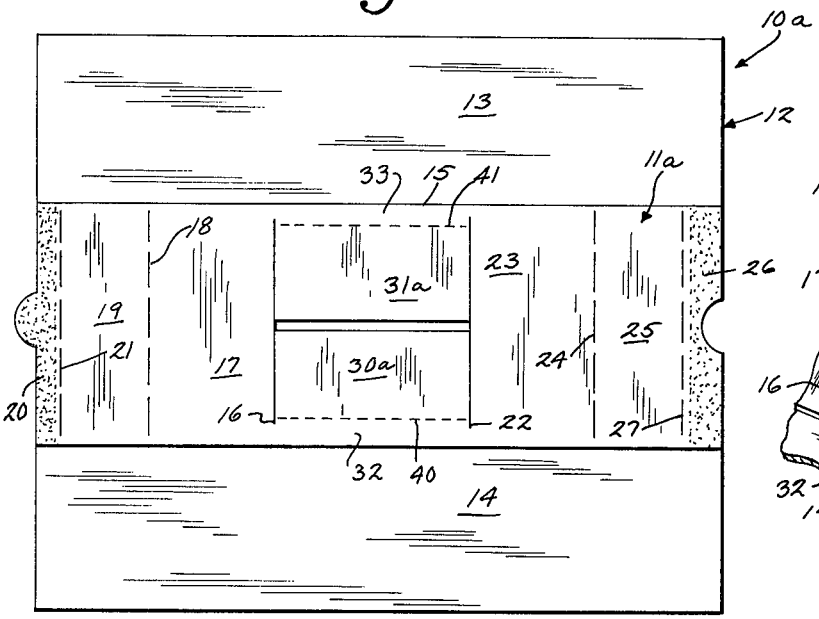
FIG. 9 is a plan view of a second embodiment of a composite wrapper according to our invention.
Figure 10:
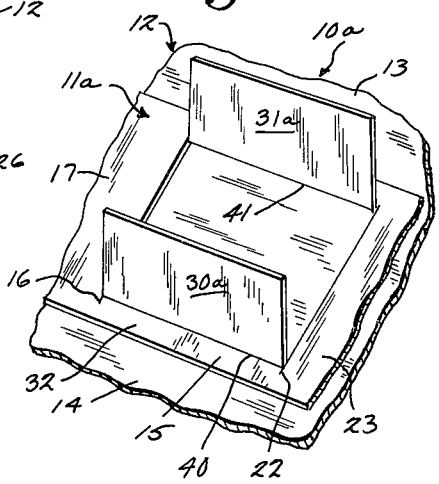
FIG. 10 is a perspective view of the composite wrapper of FIG. 9 showing the liftable flaps in their upright position.

The final steps of the wrapping process are illustrated in FIGS. 7 and 8. After the condition of FIG. 5 has been reached, the operator next tucks in the marginal portions 13 and 14 of the flexible member 12 in order to close the two ends of the package. The initial phase of one form of this closure is illustrated in FIG. 7 wherein the portions 13 and 14 have been folded downwardly to first close off the two ends of the package, following which the remaining portions are folded to the condition illustrated in FIG. 8 to complete the end closure. Other types of closure folding can be employed, such as twisting the portions 13 and 14, to close off the ends of the package. The completed package is illustrated in FIG. 8 and is ready for storage or delivery to the customer, whichever the case may be. When packaging food products, the finished packages can be stored and kept warm until purchased by a customer.

c. FIGS. 9 and 10

Figure 11:
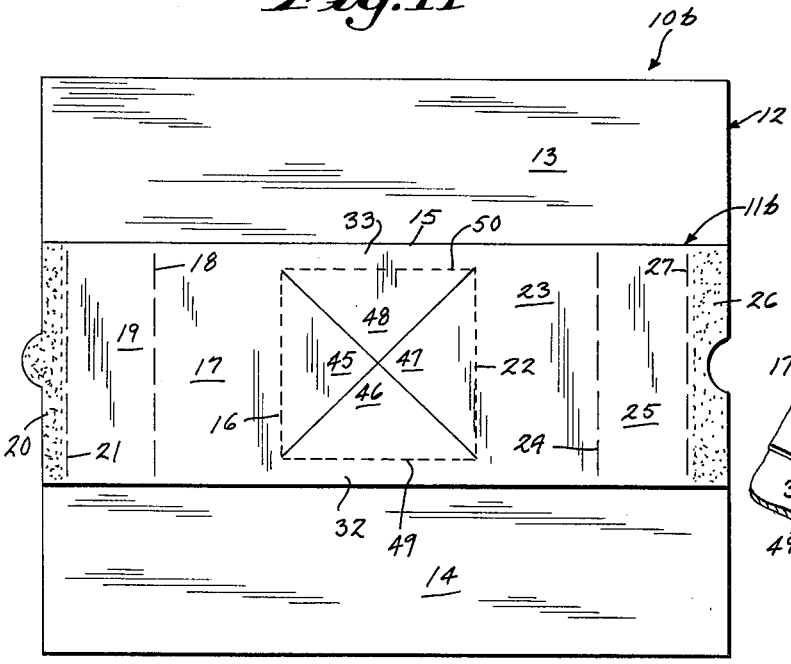
FIG. 11 is a plan view of a third embodiment of a composite wrapper according to our invention.
Figure 12:
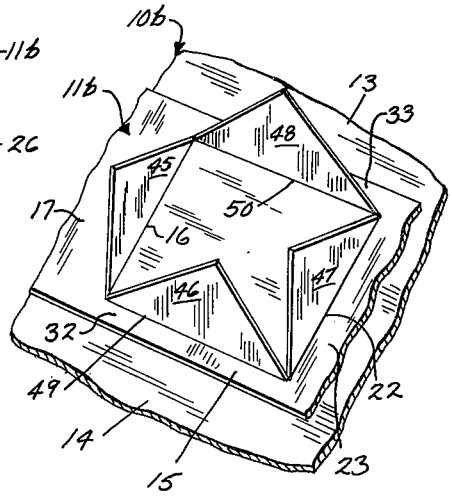
FIG. 12 is a perspective view of the composite wrapper of FIG. 11 showing the liftable flaps in their upright position.

FIGS. 9 and 10 illustrate a second embodiment of our invention comprising a composite wrapper 10*a* which includes a rigid member 11*a* joined to a flexible member 12. The rigid member 11*a* is formed to have panels similar to those of the rigid member 11 of the wrapper 10 of FIG. 1 except that its base panel 15 includes a pair of liftable flaps 30*a* and 31*a* which are arranged parallel to the longitudinal axis of the rigid member 11*a* instead of being arranged transversely to the longitudinal axis as is the case with the relationship between the flaps 30 and 31 and the rigid member 11 of FIG. 1. The liftable flap 30*a* is connected to side portion 32 of the base panel 15 along fold line 40 and liftable flap 31*a* is connected to side portion 33 along fold line 41. The condition of the wrapper 10*a* when the liftable flaps 30*a* and 31*a* are raised to their upright position as illustrated in FIG. 10. The composite wrapper 10*a* allows the liftable flaps to form a rigid wall enclosure at the ends of the package when in its final condition and may thereby provide additional protection for the packaged article.

d. FIGS. 11 and 12

A third embodiment of our invention, a composite wrapper 10*b*, is illustrated in FIGS. 11 and 12. A rigid member 11*b* is joined to a flexible member 12 to form a composite wrapper 10*b*. The base panel 15 of the rigid member 11*b* is formed to include four liftable flaps 45, 46, 47, and 48. The liftable flap 46 is connected along fold line 49 to the side portion 32 and liftable flap 48 is connected along fold line 50 to the side portion 33 of the base panel. Liftable flap 45 is joined to first wall panel 17 along fold line 16, and liftable flap 47 is joined to section wall panel 23 along fold line 22. FIG. 12 illustrates the four liftable flaps 45, 46, 47, and 48 when raised to their upright position and ready to receive an article between them. The construction of the base panel 15 of the composite wrapper 10*b* thus provides the feature of having a liftable flap on four sides of an article to be packaged in the composite wrapper.

The packages as described above exhibit a number of advantages which can be of aid in various applications. The composite wrappers 10, 10*a* and 10*b* as illustrated above are one-piece constructions, thereby eliminating the need for separate carton elements which need to be overwrapped with flexible film. The constructions utilize little space and a stack of the wrappers can be readily stored at the point of use. The wrapping operation as would be utilized in a restaurant, store or other business is a simple procedure which requires no special equipment and can be readily learned by the operator. The final packages, such as illustrated in FIG. 8, create a fresh-wrapped appearance, thereby increasing customer appeal. Lastly, when the customer receives food in the finished package, he can merely unwrap the container and it will serve as a tray to hold the food while it is being eaten; the package can be readily opened and rested flat on the lap of the person or on a table or other support.

The composite wrappers as illustrated above are also capable of other modifications within the concept of our present invention. Although the packages have been illustrated as having a rectangular shape, other configurations may be employed by incorporating wall panels of suitable structure hinged to opposite ends of the base panel. Thus, it would be possible to form a package having a generally triangular cross section, a curved cross section, or a package having a triangular or curved top wall extending across the top of the container. Other modifications will suggest themselves to those of ordinary skill in the art upon reading the foregoing disclosure of the presently-preferred embodiments, and is intended to cover such modifications as are within the true scope of our present invention.

We claim:

1. A composite wrapper comprising, in combination:

a rigid foldable member joined to a flexible packaging film member, the rigid foldable member including a base panel having a pair of opposed edges and liftable flaps that are foldable to an upright position relative to the flexible member, the rigid foldable member also including wall panels connected to said opposed edges of the base panel and foldable to an upright condition to enclose an article carried between the liftable flaps when upright to form a sleeve about such article, and the flexible member having marginal portions extending beyond either side of the rigid member that are foldable to close each end of the sleeve formed upon folding of the rigid member and thereby complete the package enclosure.

2. A composite wrapper according to claim 1, wherein:

the wall panels connected to the base panel of the rigid foldable member include first and second wall panels connected to opposed sides of the base panel, a third wall panel connected to the first wall panel, and a fourth wall panel connected to the second wall panel, the first and second wall panels being arranged to be positioned alongside the liftable flaps when upright and the third and fourth wall panels arranged to extend across the liftable flaps when upright.

3. A composite wrapper according to claim 2 further including:

a closure tab connected to each of the third and fourth wall panels along an edge thereof opposite from the first and second wall panels respectively, the closure tabs being arranged to be joined together when the wrapper is folded about an article.

4. A composite wrapper according to claim 1, wherein:

the base panel of the rigid foldable member has a pair of liftable flaps arranged parallel to the longitudinal centerline of the rigid foldable member.

5. A composite wrapper according to claim 1, wherein:

the base panel of the rigid foldable member has a pair of liftable flaps arranged transversely to the longitudinal centerline of the rigid foldable member.

6. A composite wrapper according to claim 1, wherein:

the base panel of the rigid foldable member has four liftable flaps.

* * * * *